US006000881A

United States Patent [19]

Becker et al.

[11] Patent Number: 6,000,881

[45] Date of Patent: Dec. 14, 1999

[54] TRENCH DRAIN

[75] Inventors: Allen R. Becker; Michael A. Funari; Donald A. Kubiak, all of Erie, Pa.

[73] Assignee: Zurn Industries, Inc., Erie, Pa.

[21] Appl. No.: 09/024,999

[22] Filed: Feb. 17, 1998

[51] Int. Cl.[6] ..... E02B 5/00

[52] U.S. Cl. ..... 405/119; 404/4; 405/52

[58] Field of Search ..... 405/119–122; 404/2, 4

[56] References Cited

U.S. PATENT DOCUMENTS

| | | | |
|---|---|---|---|
| 469,044 | 2/1892 | Jungbluth | 404/2 X |
| 1,223,240 | 4/1917 | Becker . | |
| 2,194,717 | 3/1940 | Older . | |
| 2,436,593 | 2/1948 | Moselowitz | 404/4 |
| 3,225,545 | 12/1965 | Flegel . | |
| 3,465,654 | 9/1969 | Fox | 404/4 |
| 3,714,786 | 2/1973 | Evans et al. . | |
| 3,788,756 | 1/1974 | Ito | 404/4 |
| 3,876,322 | 4/1975 | Deason | 404/2 |
| 3,898,778 | 8/1975 | Erickson et al. . | |
| 4,490,067 | 12/1984 | Dahowski | 404/4 |
| 4,498,807 | 2/1985 | Kirkpatrick et al. | 405/43 |
| 4,560,302 | 12/1985 | Karbstein | 404/4 |
| 4,626,130 | 12/1986 | Chapin | 405/44 |
| 4,640,643 | 2/1987 | Williams | 404/4 |
| 4,787,773 | 11/1988 | Kehler | 405/118 |
| 4,815,888 | 3/1989 | Stegmeier | 404/4 |
| 4,838,727 | 6/1989 | Capuano | 404/2 |
| 4,878,782 | 11/1989 | Beattie et al. | 405/119 |
| 4,923,330 | 5/1990 | DeTommaso | 405/36 |
| 4,993,877 | 2/1991 | Beamer | 405/282 |
| 4,993,878 | 2/1991 | Beamer | 405/282 |
| 4,997,312 | 3/1991 | Regan | 405/37 |
| 5,000,621 | 3/1991 | Beamer | 405/282 |
| 5,026,202 | 6/1991 | Thomann | 404/4 |
| 5,066,165 | 11/1991 | Wofford et al. | 405/119 |
| 5,181,793 | 1/1993 | Dekel | 404/4 |
| 5,226,748 | 7/1993 | Bärenwald et al. | 405/121 |
| 5,256,000 | 10/1993 | Beamer | 405/119 |
| 5,281,052 | 1/1994 | Beamer | 405/119 |
| 5,326,189 | 7/1994 | Beamer | 405/119 |
| 5,326,190 | 7/1994 | Beamer | 405/119 |
| 5,399,047 | 3/1995 | Stegall | 405/119 |
| 5,718,537 | 2/1998 | Becker et al. | 405/119 |

FOREIGN PATENT DOCUMENTS

| | | |
|---|---|---|
| 2161190 | 1/1986 | United Kingdom . |
| 2222624 | 3/1990 | United Kingdom . |

*Primary Examiner*—Dennis L. Taylor

*Attorney, Agent, or Firm*—Webb Ziesenheim Logsdon Orkin & Hanson, P.C.

[57] ABSTRACT

A modular trench drain for use in a trench drain system. The trench drain includes an open-faced channel including a narrow throat into which water can flow and a wider flow passage. The trench drain can include an integrally formed, removable cover which renders the channel close-faced. The removable cover is removed after installation of the drain. The throat can be offset to allow curbside installation of the trench drain. Protuberances are provided to secure the drain in the material in which the trench drain is embedded. Securement clips are provided for receiving support rods and reinforcing rods to ease installation and to provide structural stability to the trench drain.

22 Claims, 12 Drawing Sheets

TRENCH DRAIN

BACKGROUND OF THE INVENTION

1. Field of the Invention

This invention relates generally to the field of trench drains, and more particularly, to a modular trench drain system.

2. Description of the Prior Art

Trench drains are used where extensive amounts of liquid must be moved from one place to another and typically transport the liquid to a drainage sewer. Trench drains are often U-shaped or V-shaped troughs and are usually installed adjacent to either roadways or buildings. They are installed in the ground and secured in concrete. In many cases, the trench drains include a grate to prevent large objects, such as debris and people, from falling into them.

Trench drain systems include several basic designs of concrete, metal and plastic. Generally, concrete trench drain systems use forms which are placed in a ditch dug in the ground. Concrete is then poured around the forms, which are removed after the concrete has set. Trench drain systems made in accordance with this method or similar methods result in relatively expensive systems due to the cost of installing and removing the forms.

Many of the expenses associated with these prior art trench drain systems have been overcome by the advent of polymeric trench drains, which can be left in place after the concrete has been poured into place and has set. These trench drains perform two functions. First, they act as a form for the concrete; and second, they act as a liner. The associated manufacturing and transportation costs with this type of trench drain are significantly less than the other types of trench drains.

However, trench drain systems made of polymeric trench drains have problems not associated with the other types of trench drain systems, namely, buckling due to the expansion of the trench drains. This typically occurs when the trench drains are installed in colder weather. They then expand in hotter weather due to the polymeric materials' high coefficient of expansion. The embedding concrete prevents the trench drains from expanding in a longitudinal direction. Therefore, the trench drains buckle and pull away from the concrete in which they are embedded to compensate for this expansion. Further, due to the pressure of wet concrete against the trench drain walls, the trench drains can deform during installation when the wet concrete is poured around the periphery of the trench drains.

A further difficulty with the prior art trench drains occurs during installation of the drain both when the drain is embedded into concrete and during subsequent construction around the drain, such as paving. Debris, such as concrete, asphalt and other construction materials, can fall into the drain. Therefore, as a final step in installation of prior art trench drains, the drain must be cleaned or flushed of the debris. The task of cleaning a drain is often difficult due to the constricted openings of trench drains. The drains are often cleaned from one end. Larger debris is often difficult to remove using this method.

A further difficulty with the prior art trench drains is that when the drains are installed curbside in a roadway, a hole must be dug to accommodate the drain. Installation of standard trench drains often requires undercutting of the curbside to place the opening immediately adjacent to the curb. This can damage the curb and add to installation expenses.

Furthermore, as in all of the above trench drain systems, installing the polymeric trench drains requires a substantial amount of hardware, i.e., nuts and bolts, which adds not only to the cost, but can also result in delays, should the installer run out of this hardware.

Therefore, it is an object of the present invention to provide a polymeric trench drain which will resist pulling away from concrete in which it is embedded during buckling due to temperature variations.

It is also an object of the present invention to provide a trench drain system that is easy to manufacture, transport and install.

It is a further object of the present invention to provide a trench drain or a trench drain system that can be installed without undercutting a curb or other structure the trench drain will abut.

It is yet another object of the present invention to minimize the amount of extraneous hardware required to install the trench drains.

SUMMARY OF THE INVENTION

A modular trench drain is provided having a longitudinally extending channel formed from two side walls and a bottom wall. The channel has an inner surface which defines a flow passage and an outer surface. The side walls are connected to the bottom wall. Each side wall has a first portion positioned adjacent to the bottom wall and a second portion connected to the first portion. The first portions are spaced apart a first lateral distance and the second portions are spaced apart a second lateral distance that is less than the first lateral distance, thereby forming a throat.

The outer surface of the channel is provided with support rod clips to engagingly receive a support rod for supporting the trench drain when the trench drain is installed. Reinforcing rod clips are provided on the outer surface of the channel to engagingly receive a reinforcing rod. Protuberances are also provided on the outer surface to interact with the concrete into which the trench drain is embedded.

A removable cover can also be provided. The removable cover is secured to the throat opposite the bottom wall to form a closed channel. Removal of the cover forms an open-faced channel. The removable cover can be integrally molded into the trench drain, wherein it is frangibly attached to the throat by a notched member.

The throat can be formed centrally above the channel or offset. When the throat is centrally formed, the first portions and the second portions are symmetric with respect to a plane extending longitudinally along the channel. When the throat is offset, the second portions are asymmetric with respect to a plane extending longitudinally along the channel while the first portions are symmetric with respect to the plane.

DESCRIPTION OF THE PREFERRED EMBODIMENTS

Figure 1:
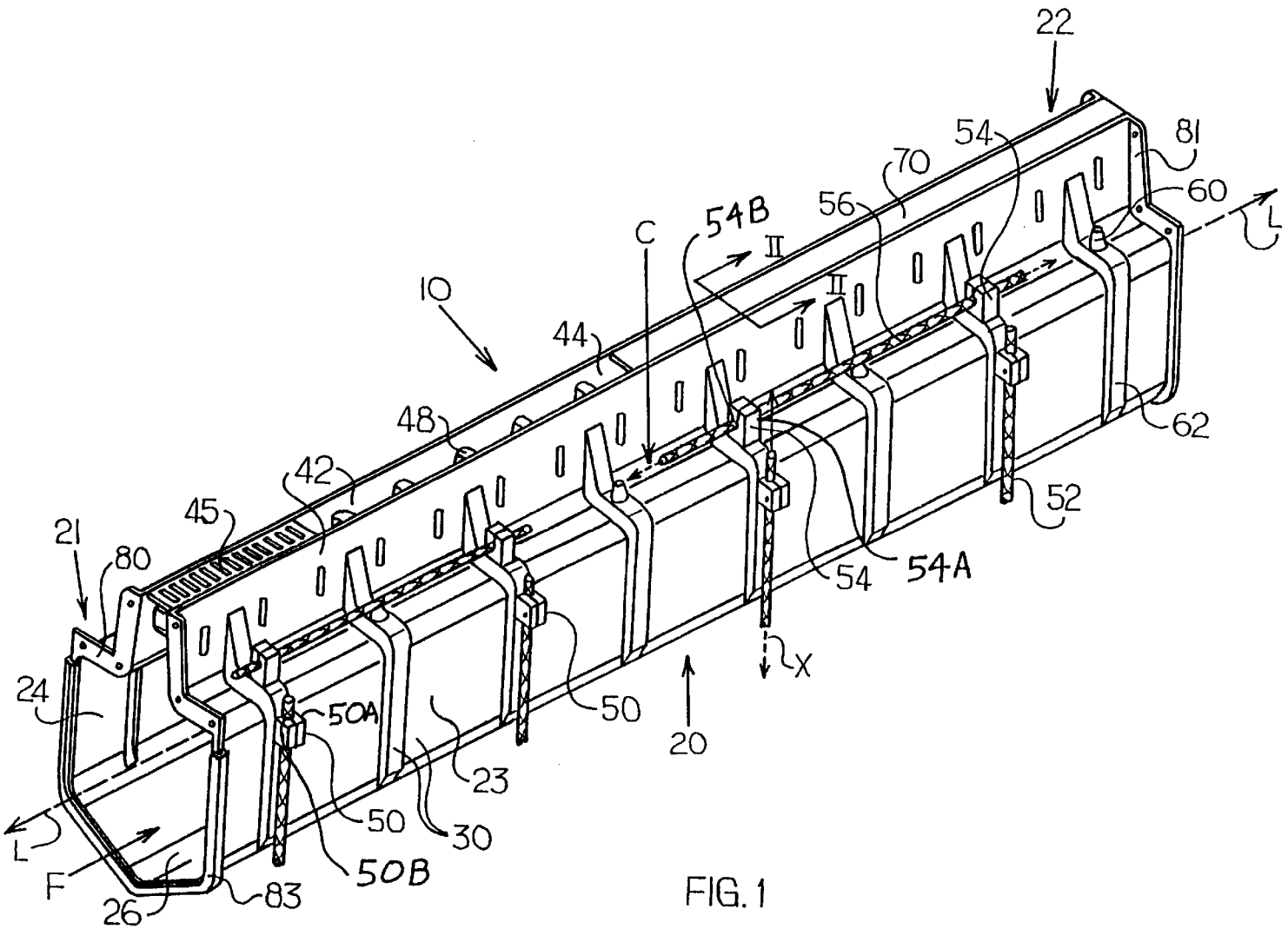
FIG. 1 is a perspective view of a first embodiment of a trench drain made in accordance with the present invention showing positioning of a support rod, a reinforcing rod, a removable cover and a grate member.
Figure 2:
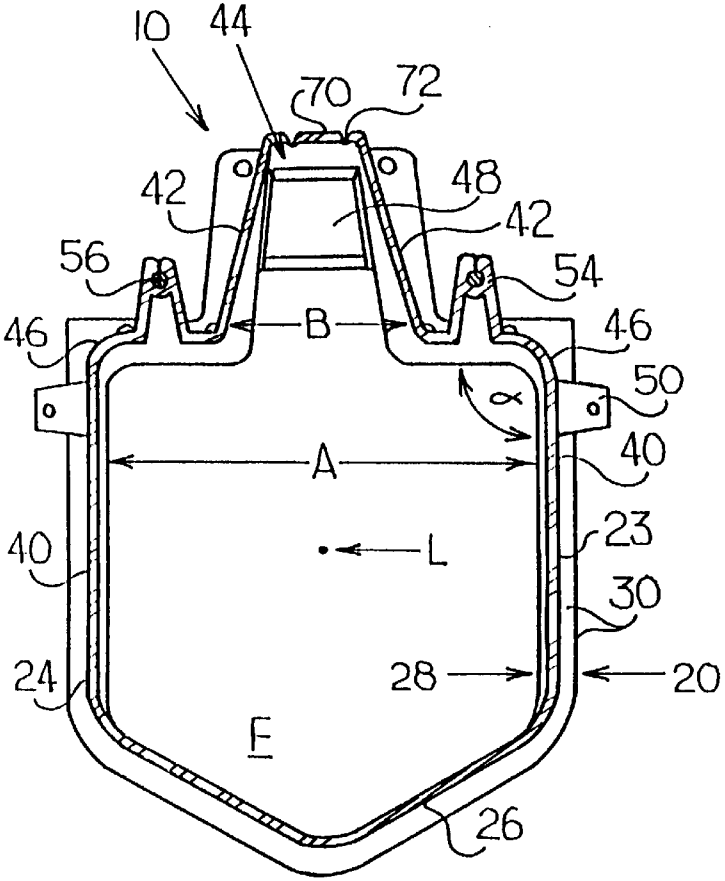
FIG. 2 is a sectional view of the trench drain taken along lines II—II in FIG. 1.

FIG. 1 shows a first embodiment of a trench drain 10 having a channel 20 made in accordance with the present invention. The trench drain 10 is molded as a single modular unit from a plastic, such as polyethylene or polyvinyl chloride, but can be formed from other materials, such as fiberglass. The channel 20 extends along a longitudinal axis L and defines a flow passage F. The channel 20 has a first end 21 and a second end 22. As shown in FIG. 2, the channel 20 includes a first side wall 23 and a second side wall 24, both connected to a bottom wall 26. Like reference numerals designate like parts. The channel 20 has an inner surface 28 and an outer surface 30. The first side wall 23 and the second side wall 24 each include a first portion 40 adjacent to the bottom wall 26 and connected to a second portion 42. The first portions 40 of the first side wall 23 and the second side wall 24 are spaced apart a first lateral distance A. The second portions 42 of the first side wall 23 and the second side wall 24 are spaced apart a second lateral distance B. The first lateral distance A is greater than the second lateral distance B. The second portions 42 form a throat 44. The throat 44 serves a number of purposes, including preventing large objects from entering the trench drain 10 and allowing the drain to be installed curbside in a roadway, about a building or in a sidewalk without having a large drain opening. As shown in FIG. 1, second portions 42 can be adapted to receive a grate member 45 upon installation of the trench drain 10.

As shown in FIG. 2, a knee portion 46 is formed in the first side wall 23 and the second side wall 24 between the first portions 40 and the second portions 42. The knee portion 46 compensates for differences in lateral distances A and B. The knee portion 46 extends from the first portion 40 at an angle $\alpha$. Angle $\alpha$ can be 90°, but may vary from 90°.

Figure 3:
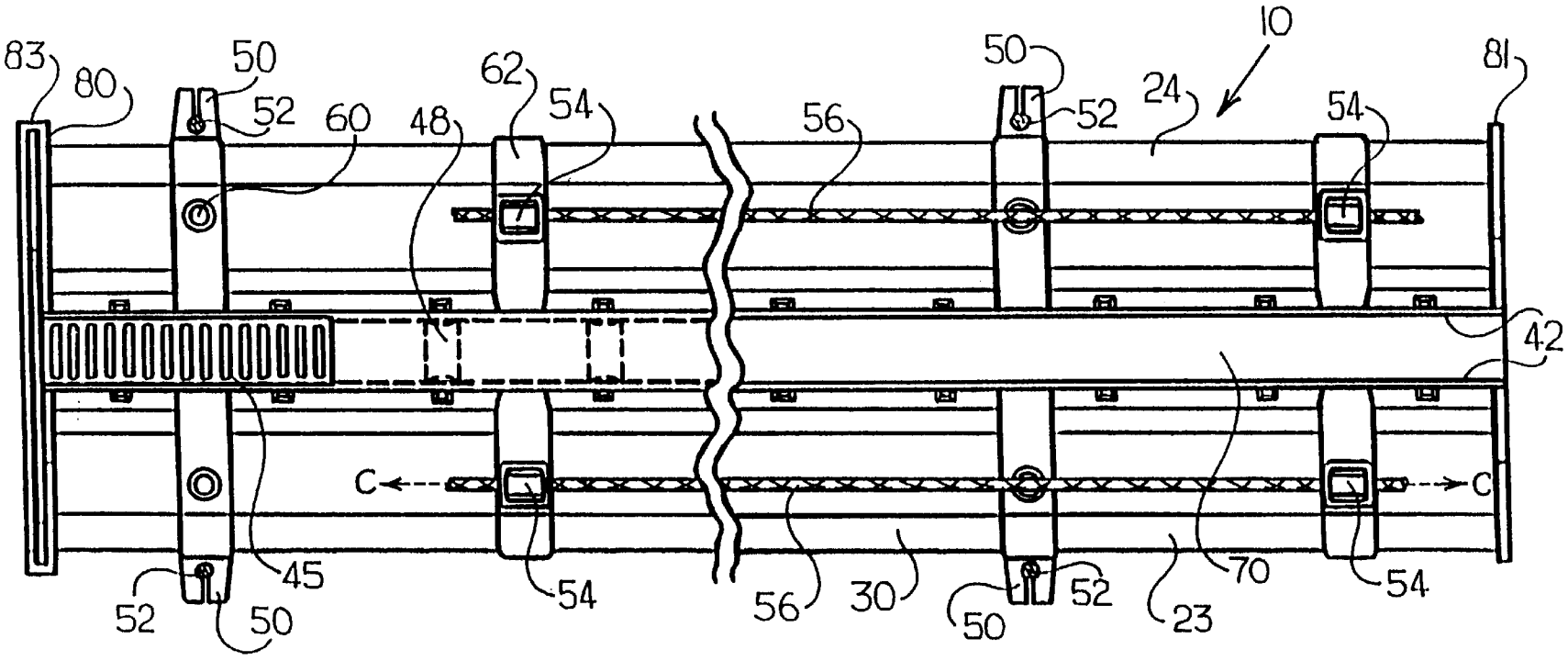
FIG. 3 is a top plan view of the trench drain shown in FIG. 1.

As shown in FIGS. 1, 2 and 3, the trench drain 10 includes a plurality of spaced apart bridging members 48 connecting the second portion 42 of the first side wall 23 to the second portion 42 of the second side wall 24. The bridging members 48 are hollow beams formed integrally into the trench drain 10 during the molding of the trench drain 10. Alternatively, the bridging members 48 are solid. The bridging members 48 add structural strength to the trench drain 10 and prevent large objects from entering the drain during and after installation.

The bridging members 48 can be adapted to receive a fastener for the grate member 45 or to engagingly receive the grate member 45. For instance, the bridging member 48 can be tapped to receive a screw which passes through the grate member 45, holding the grate member 45 in place on the bridging member 48. In another embodiment (not shown), the bridging members 48 can be provided with tabs which pass through holes in the grate members 45. The tabs can be provided with ridges which engage a surface of the grate members 45 opposite the bridging members 48. Alternatively, the grate member 45 rests upon the second portions 42 which are adapted to receive and, optionally, engage the grate member 45. Lastly, the bridging members 48 can be suitably spaced so that no grate members 45 are necessary (not shown).

As shown in FIG. 1, a plurality of first clips or support rod clips 50 is attached to the outer surfaces 30 of the first side wall 23 and the second side wall 24. The clips 50 include two legs, as shown in FIG. 3, and can include screw receiving holes. Screws can be received in the screw receiving holes to draw the legs toward each other. Each support rod clip 50 includes a body 50A that includes the two legs. The body defines a support rod passageway 50B. The support rod clips 50 are adapted to engagingly receive a support rod 52, such as a piece of rebar or other suitably rigid material, such as plastic or fiberglass, in a first orientation or first axis X to support the trench drain 10 in a trench or ditch.

Figure 9:
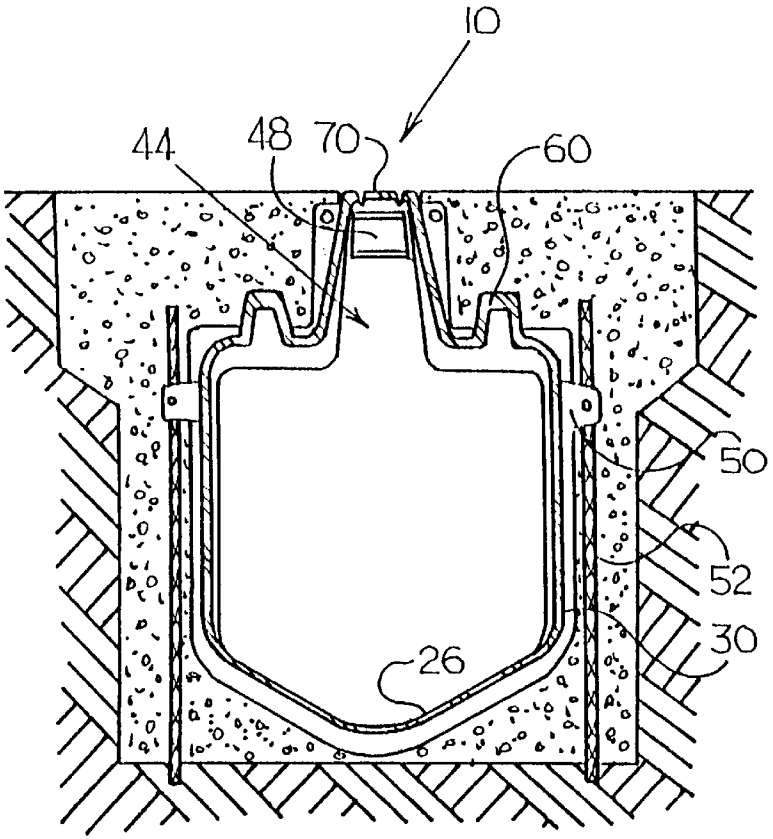
FIG. 9 is an elevational view, partially in section, of the trench drain shown in FIG. 1 embedded in concrete showing protuberances.
Figure 8:
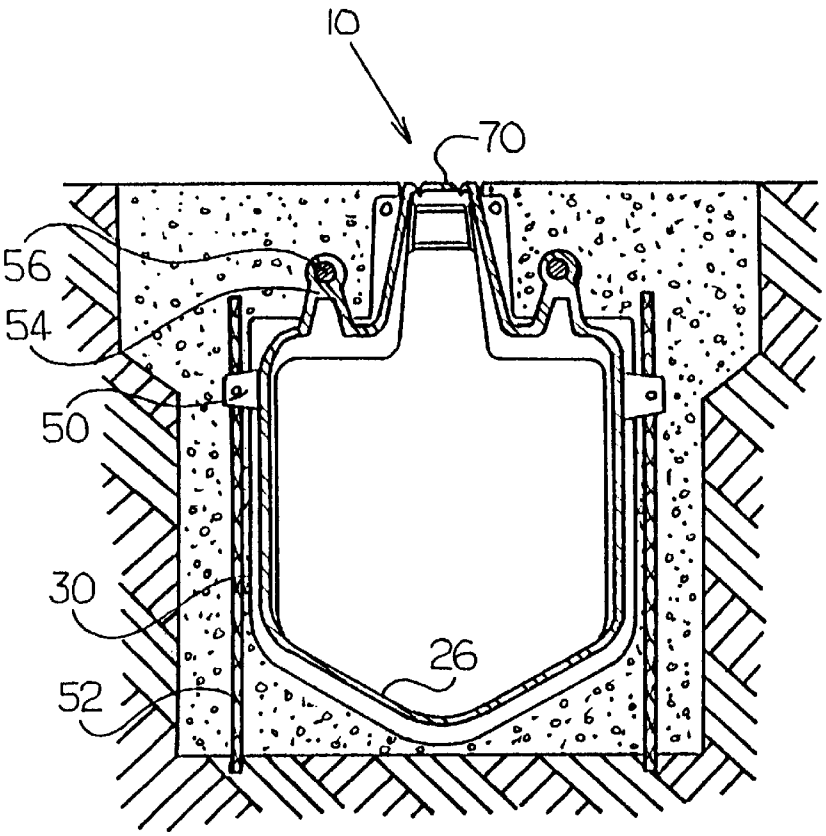
FIG. 8 is an elevational view, partially in section, of the trench drain shown in FIG. 1 and embedded in concrete.

FIGS. 8 and 9 show the support rod 52 extending beyond the bottom wall 26 so that when the trench drain 10 is placed into the trench, the support rods 52 lift the trench drain 10 in the trench allowing concrete or other support material to flow freely about the outer surface 30 of the trench drain 10.

Figure 4:
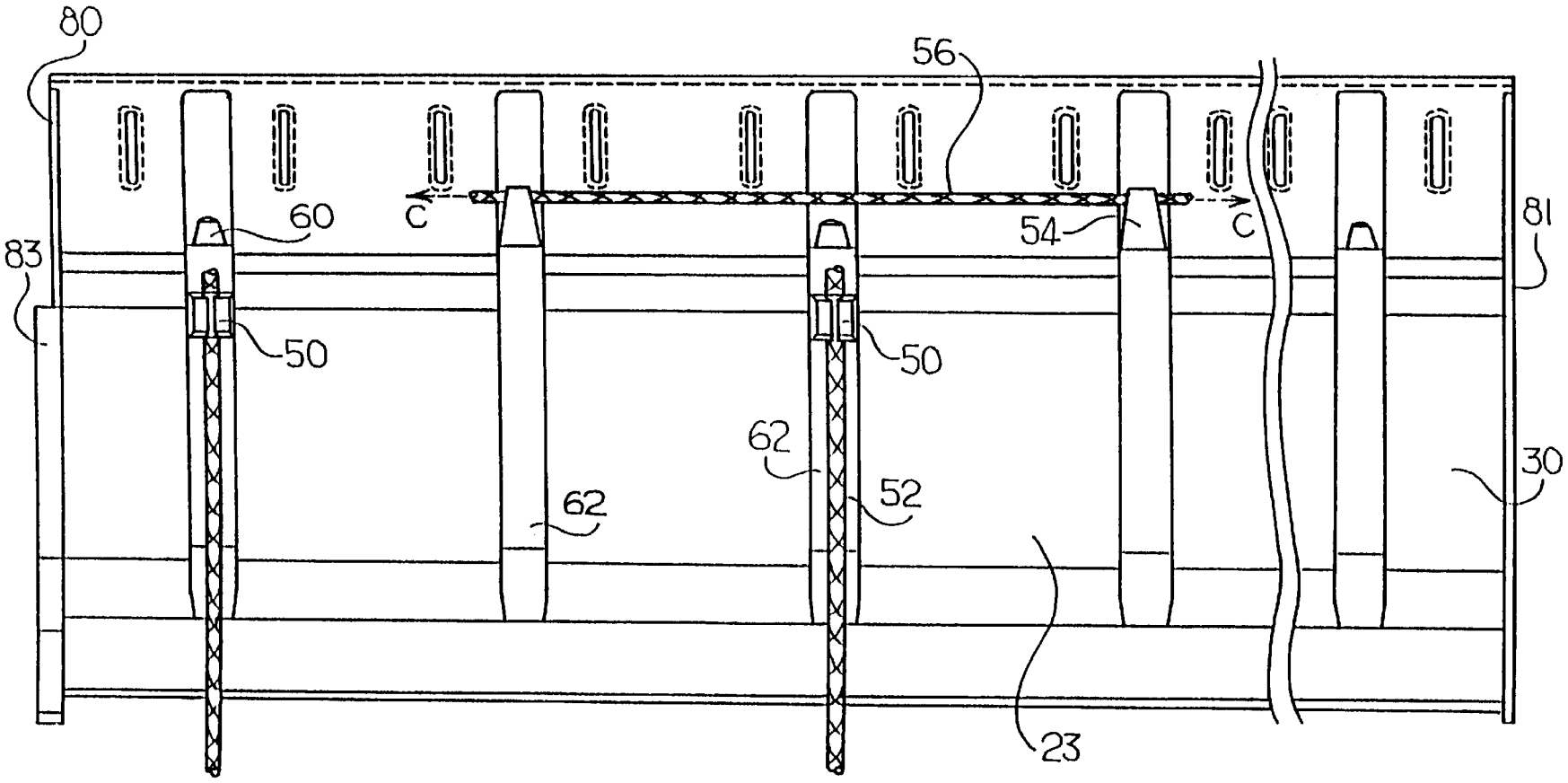
FIG. 4 is a side elevational view of the trench drain shown in FIG. 1.
Figure 5:
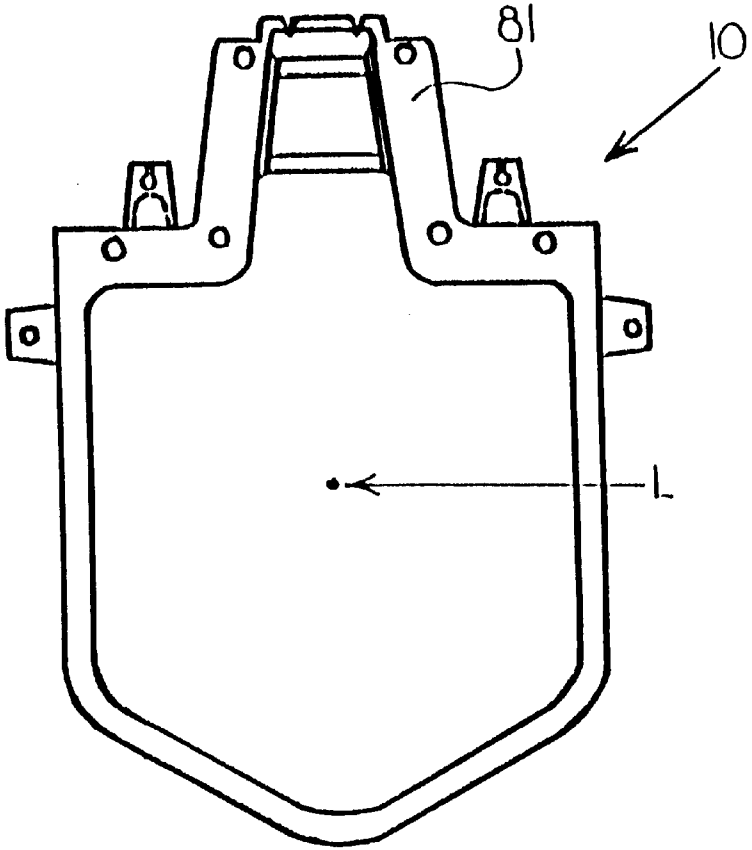
FIG. 5 is a side elevational view of a first end of the trench drain shown in FIG. 1.
Figure 6:
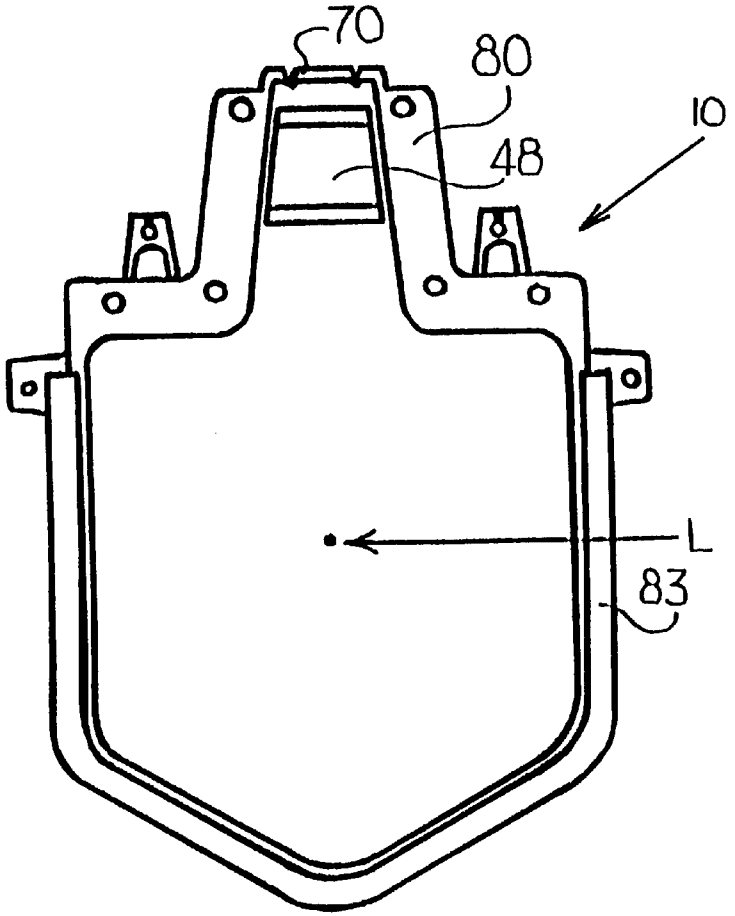
FIG. 6 is a side elevational view of a second end of the trench drain shown in FIG. 1.

As shown in FIG. 1, a plurality of second clips or reinforcing rod clips 54 is attached to the outer surfaces 30 of the first side wall 23 and the second side wall 24. The reinforcing rod clips 54 are adapted to engagingly receive a reinforcing rod 56 in a longitudinal orientation along a second clip axis C. Each reinforcing rod clip 54 includes a body 54A which defines each reinforcing rod clip passageway 54B. As shown in FIGS. 1, 3 and 4, two or more of the second clips 54 can be adapted to engagingly receive the single reinforcing rod 56. To accomplish this, the two reinforcing rod clips 54 are affixed to the outer surface 30 so that the second clip axes C are coaxial. The reinforcing rods 56 are inserted into the reinforcing rod clips 54 prior to embedding of the trench drain 10. The first axis X in which the support rod 52 extends is not parallel to the second clip axis C in which the reinforcing rod 56 extends. The first axis X and second axis C can be transverse as shown in FIG. 1.

As shown in FIG. 1, axes L and C are parallel to each other and axis X is transverse to axes L and C. The support rod clips 50 and the reinforcing rod clips 54 can be a unitary member having a central passage for engagingly receiving the support rods 52 and the reinforcing rods 56. Alternatively, the clips 50 and 54 can include two members (not shown), one of which is hinged. The clips 50 and 54 are opened to receive a rod 52 or 56. Once the rod 52 or 56 is placed in the clips 50 and 54, the two members are engaged in a closed position to form a passage into which the support rod 52 or the reinforcing rod 56 is engagingly received. The clips 50 and 54 can be integrally molded with the trench drain 10. The reinforcing rods 56 provide reinforcement of the trench drain 10 along the second clip axis C, as well as concrete embedding the trench drain 10.

Another feature of the present invention is protuberances 60 which are attached to the outer surface 30. The protuberances 60 can be frusto-conical shaped, as shown in FIG. 1, cylindrical, mushroom shaped or otherwise suitably shaped to interact with material, such as concrete, into which the outer surface 30 of the trench drain 10 is embedded.

As shown in FIG. 1, the channel 20 is configured having a peripheral rib member 62. The peripheral rib member 62 is a supporting rib member which extends at least partially about the outer surface 30 of channel 20 to, among other things, provide further support in maintaining the shape of the channel 20. As shown in FIG. 1, the peripheral rib members 62 can extend in a plane normal to the longitudinal axis L. The peripheral rib members 62 can have one or more of the clips 50 and 54 and the protuberances 60 attached thereto, as shown in FIG. 1.

Figure 7:
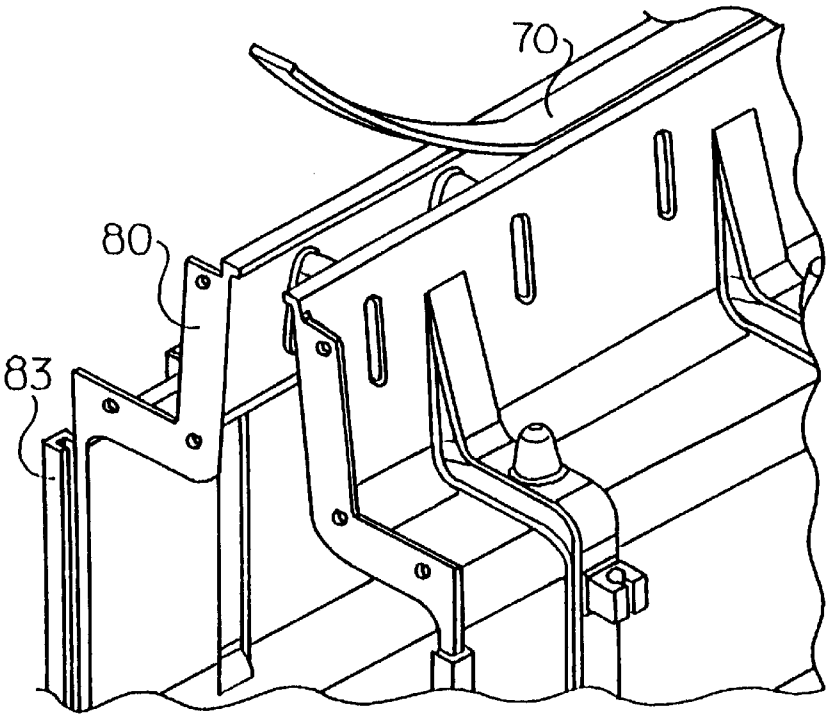
FIG. 7 is a perspective view of a portion of a first end of the trench drain shown in FIG. 1 prior to complete removal of the removable cover on the first end.

The channel 20 includes a removable cover 70. The removable cover 70 is secured to the throat 44 and is positioned opposite the bottom wall 26 to form a closed-faced channel as shown in FIG. 2. Removal of the removable cover 70 forms an open-faced channel. The removable cover 70 can be a cap (not shown) which is molded separately from the trench drain 10 and secured to the throat 44. Preferably, as shown in FIG. 2, the removable cover 70 is molded integrally with the trench drain 10. The removable cover 70 is frangibly connected to or secured to the throat 44 by notched members 72. The notched members 72 are formed integrally with the trench drain 10 by molding a groove into an integrally molded trench drain 10 between the removable cover 70 and the throat 44. Alternatively, the notched member 72 can be formed into the integrally molded trench drain 10 after molding, such as by cutting. FIG. 7 shows an end of the trench drain 10 of FIG. 1, wherein the removable cover 70 is partially removed. The removable cover 70 can be flexible or rigid, as desired. Flexibility of the removable cover 70 is determined by the thickness of the cover, its shape and the type of material used to form the removable cover 70.

Referring to FIG. 1, the first end 21 can have a flange 80 and the second end 22 can have a second flange 81. The purpose of the flanges 80 and 81 is to facilitate joining of sections of the trench drain 10. As shown in FIG. 1, the first end 21 is provided with a peripheral groove member 83, the flange 80 and the peripheral groove member 83 forming a female section. The female section engagingly or matingly receives a second flange 81, a male section of a second end 22 of an adjacent trench drain 10. In an alternative embodiment (not shown), the peripheral groove member 83 can be formed on the second flange 81 of the second end 22, instead of on the flange 80 of the first end 21 to engagingly receive the flange 80 of the first end 21 of an adjacent section of the trench drain 10.

Figure 10:
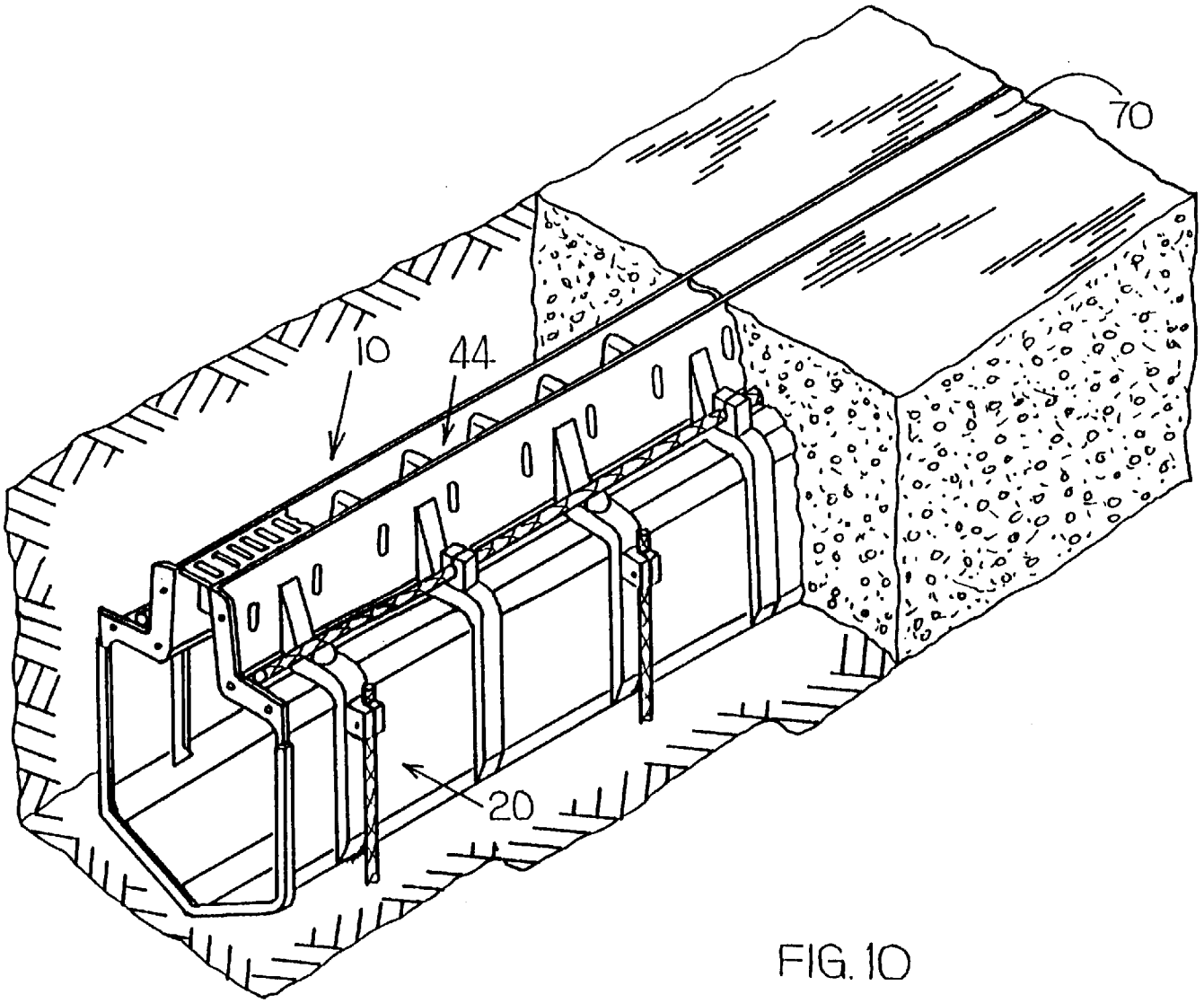
FIG. 10 is a perspective view, partially in section, of the trench drain shown in FIG. 1 embedded in concrete and partially covered with a removable cover.

In use, the trench drain 10 is embedded into the ground or, preferably, into a hard-setting material, such as concrete, as shown generally in FIGS. 8–10. A single modular unit of the trench drain 10, or a plurality of such units, can be installed. For installation of the trench drain 10, a trench is dug having dimensions sufficiently large enough to accommodate the trench drain 10. A section of the trench drain 10 is placed into the trench and is secured to other sections of trench drains 10. Screws can be used to secure adjacent sections of trench drains 10 through holes defined in flanges 80 and 81. Concrete is then poured about the outer surface 30 of sections of the trench drain 10 to permanently embed and support the trench drain system thereby formed.

Sections of the trench drain 10 are fastened to each other in a variety of ways. Where the sections are provided with flanges 80 on both ends 21 and 22 of the trench drain 10, two trench drains 10 are placed in a trench abutting each other and the sections are directly fastened together with suitable fasteners (not shown). Fasteners include, but are not limited to, screws, bolts and rivets. In another embodiment where one end of the trench drain 10 is provided with a flange 80 having a peripheral groove member 83, as shown in FIG. 1, after a first trench drain 10 is placed in a trench, a second trench drain 10 is placed into the trench so that the second flange 81 of the second trench drain 10 is inserted into and is engagingly received by the peripheral groove member 83. Once the adjacent trench drains 10 are positioned, the adjacent sections of trench drains 10 can be further fastened together by fastening abutting flanges 80 and 81 to each other with fasteners, such as screws, bolts and rivets.

Alternatively, the first end 21 can be provided with a lip and with no flange 80 or peripheral groove member 83. The lip is suitably configured as a male section for engaging insertion into the second end 22 of an adjacent section of the trench drain 10, which acts as a female section (not shown).

After the trench drain 10 is embedded, construction work often continues about the installation site. Once the drain is installed, the road or adjacent area is paved or otherwise suitably finished. During embedding of the trench drain 10 and during paving, construction material and other debris can fall into an open-faced trench drain. To prevent this, the removable cover 70 is kept attached to the trench drain 10 during construction, leaving the channel 20 close-faced. After construction has ended, the removable cover 70 is removed, rendering the channel 20 open faced, allowing water to pass through the throat 44 into the channel 20.

If the removable cover 70 is frangibly attached to the trench drain 10, for instance through notched members 72, the frangible attachment or notched members 72 are broken to remove the removable cover 70. FIG. 8 shows the trench drain 10 embedded in concrete prior to removal of the removable cover 70. FIG. 10 shows the trench drain 10 partially embedded in concrete after partial removal of the removable cover 70. During the embedding process, bridging members 48 prevent buckling and collapsing of the throat 44. Once the removable cover 70 is removed, grate members 45 can be inserted into the throat 44 as shown in FIGS. 1 and 3. The protuberances 60 coact with the concrete to prevent the trench drain 10 from pulling from the concrete.

Figure 11:
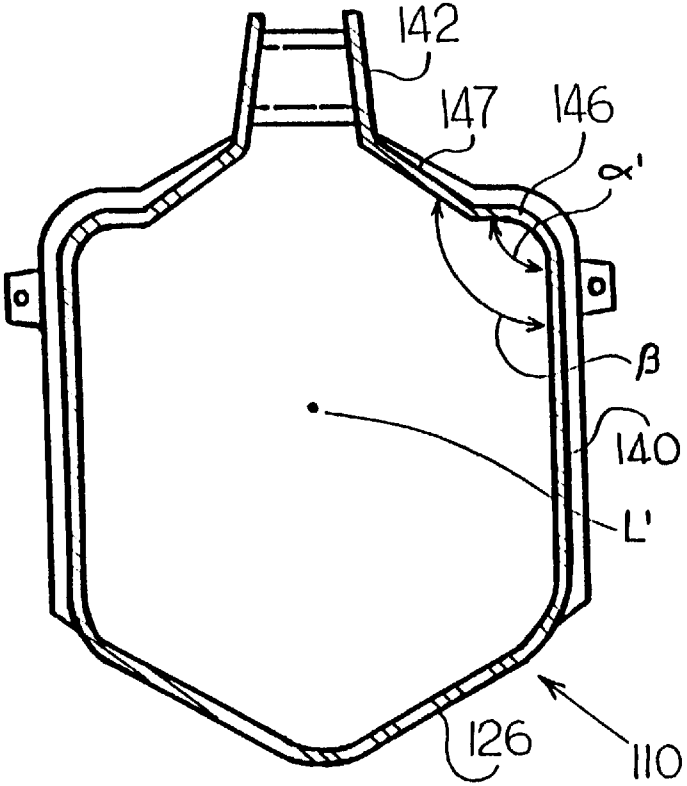
FIG. 11 is a sectional view of a second embodiment of a trench drain made in accordance with the present invention having a knee extension.

FIG. 11 shows a second embodiment of a trench drain 110 similar to the trench drain 10 shown in FIGS. 1–10, with the exception of the structure of the knee portion 46. The trench drain 110 includes a bottom wall 126, first portions 140, second portions 142 and knee portions 146. Specifically, the knee portion 146 extends from the first portion 140 toward the second portion 142 and an angled knee extension 147 is positioned between the knee portion 146 and the second portion 142. The knee extension 147 extends at a knee extension angle β relative to the first portion 140. The knee extension angle β is greater than angle α', which is the same as angle α described in reference to FIG. 2. In a further embodiment of the trench drain 10 (not shown), the channel 20 of the trench drain 10 can be substantially semi-circular in a cross section normal to longitudinal axis L'.

Figure 13:
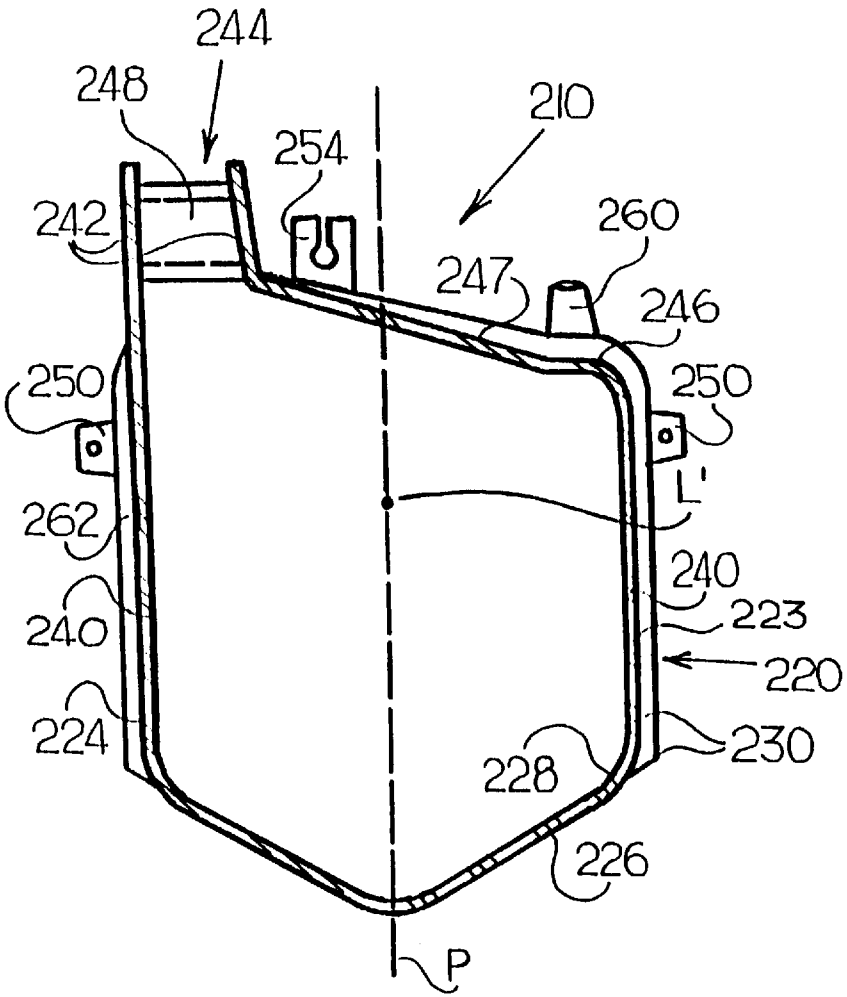
FIG. 13 is a sectional view taken along lines XIII—XIII in FIG. 12.
Figure 12:
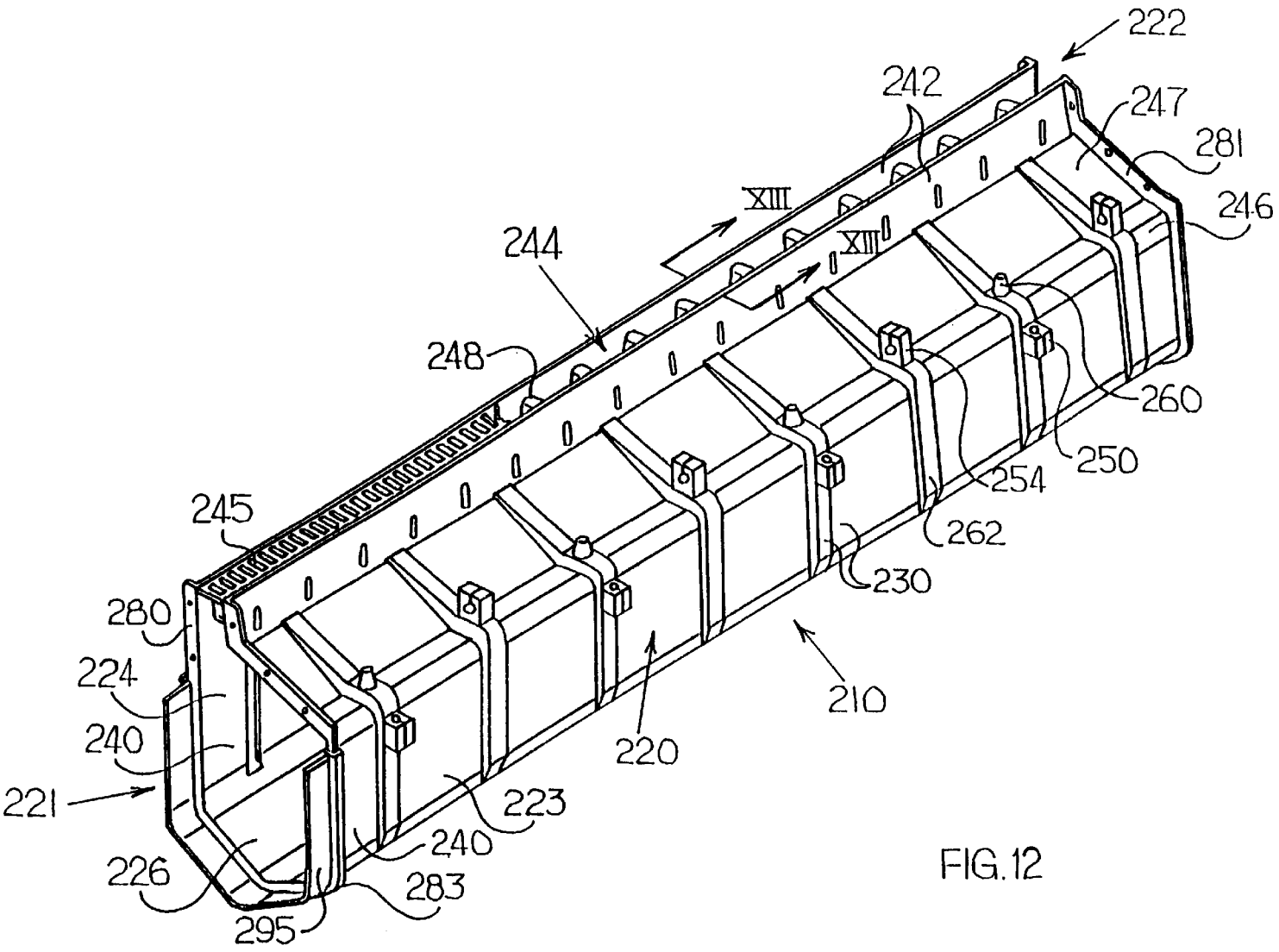
FIG. 12 is a perspective view of a third embodiment of a trench drain made in accordance with the present invention having an offset throat and a knee extension.
Figure 14:
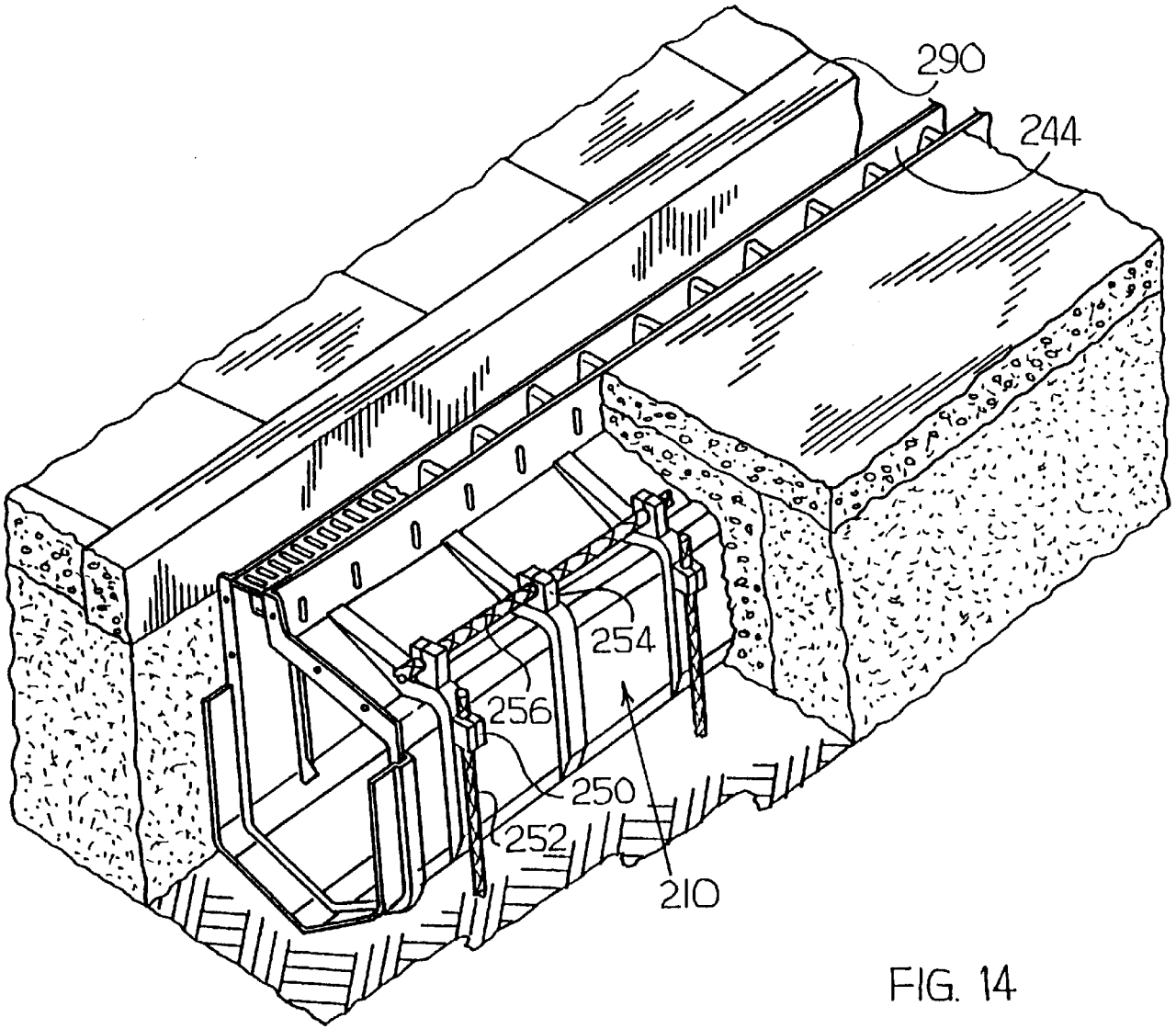
FIG. 14 is a perspective view, partially in section, of the trench drain having an offset throat shown in FIG. 12 embedded in concrete adjacent to a curb of a roadway.

FIGS. 12–14 show a third embodiment of a trench drain 210 made in accordance with the present invention. The trench drain 210 includes a channel 220, a first end 221, a second end 222, a first side wall 223, a second side wall 224, a bottom wall 226, an inner surface 228, an outer surface 230, first portions 240, second portions 242, a throat 244, a grate member 245, a knee portion 246, a knee extension 247, a bridging member 248, support rod clips 250, reinforcing rod clips 254, protuberances 260, peripheral rib members 262, a flange 280, a second flange 281 and a peripheral groove member 283 substantially as described in reference to the trench drain 10 of FIGS. 1–10. Like reference numerals in FIGS. 12–14 designate like parts. In this embodiment, the second portions 242 of the trench drain 210, forming the throat 244, are offset. As shown in FIG. 13, the second portions 242 are asymmetric with respect to a center plane P extending along longitudinal axis L' while the first portions 240 of the first side wall 223 and the second side wall 224 are symmetric with respect to the center plane P. The second portions 242 can both lie on the same side of the center plane P, as shown in FIG. 13, or on opposite sides of the center plane P (not shown). In the embodiment shown in FIG. 13, the first portion 240 and the second portion 242 of the second side wall 224 are substantially co-planar. Alternatively, the first portion 240 and the second portion 242 of the first side wall 223 are substantially co-planar with the knee portion 246 being in the second side wall 224.

As shown in FIG. 14, the trench drain 210 having an offset throat 244 is installed curbside in a roadway. The trench drain 210 is prepared by insertion of support rods 252 and reinforcing rods 256 into support rod clips 250 and reinforcing rod clips 254, respectively. A trench is dug adjacent to a curb 290 to accommodate the sections of the trench drain 210. In this embodiment, because the throat 244 is offset, the curb 290 need not be undercut to accommodate the trench drain 210. Once the trench drain 210 is positioned, and preferably embedded, the roadway can be paved.

Additionally, FIG. 12 shows a further arrangement for joining trench drains. In this embodiment, a flange 280 on the first end 221 can include the peripheral groove member 283 and a lip 295 extending in a longitudinal direction from the peripheral groove member 283 to form a female section. The second flange 281 is provided on the second end 222 to form a male section. The lip 295 is provided to engage an outer surface 230 of the second end 222 of an adjacent section of the trench drain 210. Alternatively, the peripheral groove member 283 and the lip 295 can be provided on the second end 222, and not on the first end 221, to engagingly receive the flange 280 of the first end 221 of an adjacent section of the trench drain 210.

Figure 15:
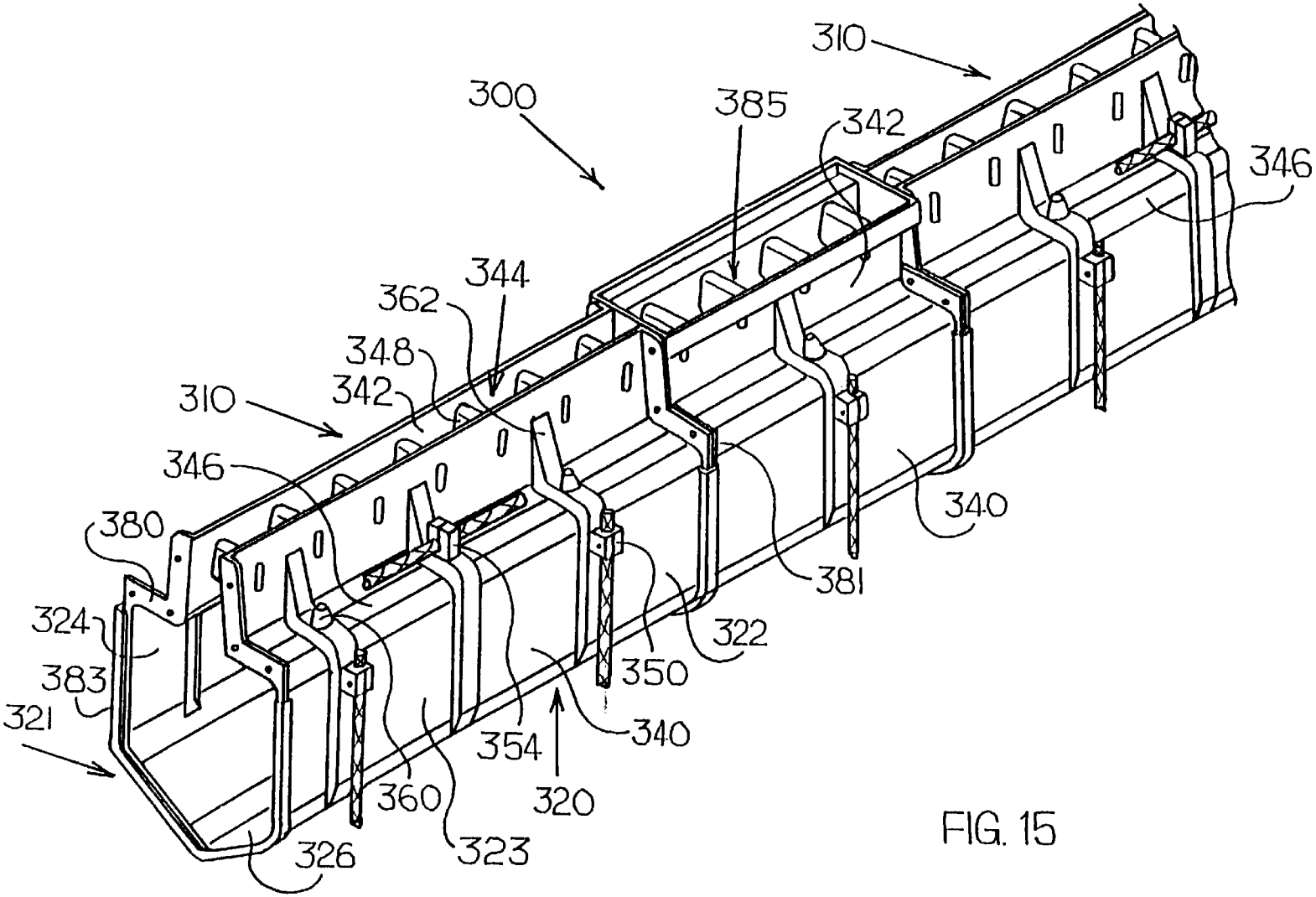
FIG. 15 is a perspective view of a drain system made in accordance with the present invention including a port section installed between two trench drains.

FIG. 15 shows an embodiment of a trench drain system 300 made in accordance with the present invention. The trench drain system 300 includes two assembled sections of a trench drain 310. Similar to the trench drain 10 shown in FIGS. 1–10, the trench drain 310 includes a channel 320, a first end 321, a second end 322, a first side wall 323, a second side wall 324, a bottom wall 326, a first portion 340, a second portion 342, a throat 344, a knee portion 346, bridging members 348, support rod clips 350, reinforcing rod clips 354, protuberances 360, peripheral rib members 362, a flange 380, a second flange 381 and a peripheral groove member 383. Sections of the trench drain 310 are joined as described above.

Figure 16:
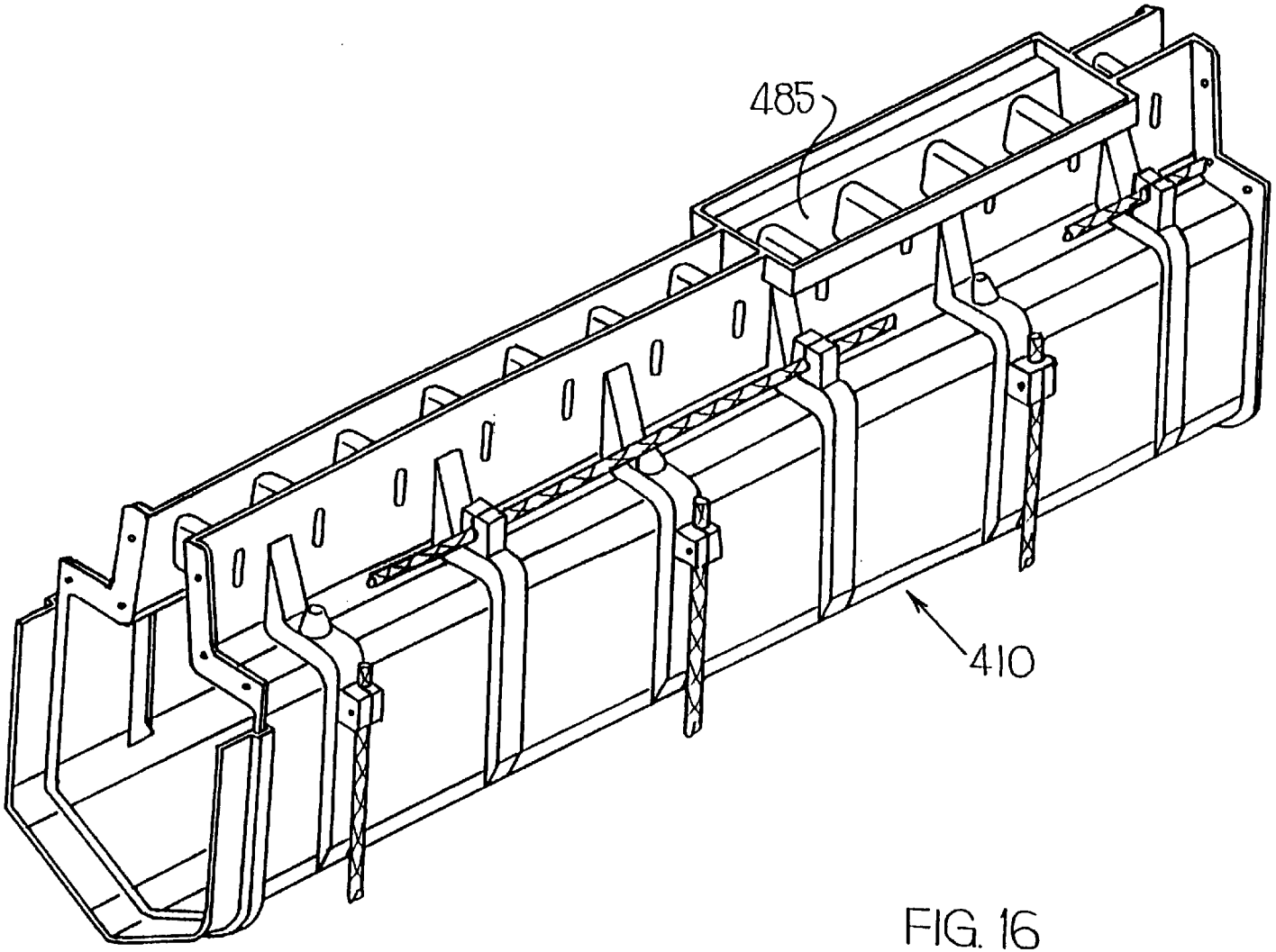
FIG. 16 is a perspective view of another embodiment of a trench drain made in accordance with the present invention having an integral port.

As shown in FIG. 15, the trench drain system 300 includes a port 385. In the port 385, the second portions 342 of the first side wall 323 and the second side wall 324 are spaced apart a lateral distance greater than the second lateral distance for the other adjacent sections of the trench drain 310. The port 385 can extend the entire length of a section of the trench drain 310 as shown in FIG. 15. Alternatively, as shown in FIG. 16, a port 485 can extend for a portion of the length of a single section of trench drain 410 and can be used to clean out debris located in the trench drain 410.

As should now be evident, the present invention provides a trench drain which resists buckling and pulling away from the concrete through addition of the protuberances and reinforcing rod clips. The trench drain, which is molded as a single unit from lightweight plastics, is easy and inexpensive to manufacture and transport. The trench drain is also easy to install and maintain having features, such as the support rod clips, the removable cover, the offset throat, the flange assemblies and the port assemblies. Further, the present invention provides a trench drain that minimizes the amount of hardware required to install the trench drains, such as through clips 50 and 54.

The above invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

We claim:

1. A trench drain, comprising:

a longitudinally extending channel extending along a longitudinal axis having a first side wall spaced apart from a second side wall, a first end and a second end, and a bottom wall connected to said first side wall and said second side wall, said channel having an inner surface and an outer surface, said inner surface defining a flow passage, each of said first side wall and said second side wall having a first portion adjacent to said bottom wall and a second portion connected to said first portion, said first portions of said first side wall and said second side wall spaced apart a first lateral distance and said second portions of said first side wall and said second side wall spaced apart a second lateral distance and form a throat, the first lateral distance greater than the second lateral distance;

a support rod clip attached to said outer surface of one of said first side wall and said second side wall, said support rod clip including a support rod clip body defining a support rod passageway for engagingly receiving a support rod extending along a first axis; and a reinforcing rod clip attached to said outer surface of one of said first side wall and said second side wall, said reinforcing rod clip including a reinforcing rod clip body defining a reinforcing rod passageway for engagingly receiving a reinforcing rod extending along a second axis wherein said first axis is not parallel to said second axis.

2. A trench drain as claimed in claim 1, wherein said first axis is transverse to said second axis.

3. A trench drain as claimed in claim 1, comprising a plurality of said reinforcing rod clips co-axial about the second axis.

4. A trench drain as claimed in claim 1, further comprising a protuberance extending from said outer surface of said channel adapted to interact with material into which said outer surface of said trench drain is embedded.

5. A trench drain as claimed in claim 1, further comprising a peripheral rib member connected to said outer surface of said channel.

6. A trench drain as claimed in claim 7, wherein said peripheral rib member extends about a perimeter of said channel in a plane normal to said longitudinal axis.

7. A trench drain as claimed in claim 1, further comprising a removable cover secured to said throat and positioned opposite said bottom wall forming a close-faced channel, whereby removing said removable cover forms an open-faced channel.

8. A trench drain as claimed in claim 7, wherein said removable cover is frangibly secured to said second portions.

9. A trench drain as claimed in claim 8, wherein said removable cover is integrally formed with said longitudinally extending channel.

10. A trench drain as claimed in claim 9, further comprising notched members securing said removable cover to said throat.

11. A trench drain as claimed in claim 1, wherein one of said first side wall and said second side wall includes a knee portion positioned between said first portion and said second portion, whereby a lateral distance of said knee portion from the other of said first side wall and said second side wall varies between said first lateral distance and said second lateral distance.

12. A trench drain as claimed in claim 1, wherein flanges are attached to said first end and to said second end of said channel, said flanges are adapted to abut a respective flange of an adjacent trench drain channel.

13. A trench drain as claimed in claim 1, wherein said first end includes a male section and said second end includes a female section, said female section being adapted to matingly receive a respective male section of an adjacent trench drain channel.

14. A trench drain as claimed in claim 13, wherein said male section comprises a flange and said female section comprises a flange having a peripheral groove defined therein, said female section adapted to receive a flange of a male section of an adjacent trench drain.

15. A trench drain as claimed in claim 1, wherein said second portions are adapted to receive a grate member to cover said throat.

16. A trench drain as claimed in claim 1, wherein said second portions of said first side wall and said second side wall are asymmetric with respect to a plane extending longitudinally along said channel, and said first portions of said first side wall and said second side wall are symmetric with respect to the plane.

17. A trench drain as claimed in claim 1, wherein said first portion and said second portion of one of said first side wall and said second side wall are co-planar.

18. A trench drain as claimed in claim 1, further comprising a plurality of bridging members connecting said second portion of said first side wall with said second portion of said second side wall.

19. A trench drain comprising:

a longitudinally extending channel defining a longitudinal axis having a first side wall spaced apart from a second side wall, said first side wall and said second side wall connected to a bottom wall, said channel having an inner surface and an outer surface, said inner surface defining a flow passage;

a support rod clip attached to said outer surface of one of said first side wall and said second side wall, said support rod clip including a support rod clip body defining a support rod passageway for engagingly receiving a support rod extending along a first axis; and a reinforcing rod clip attached to said outer surface of one of said first side wall and said second side wall, said reinforcing rod clip including a reinforcing rod clip body defining a reinforcing rod passageway for engagingly receiving a reinforcing rod extending along a second axis, wherein the first axis is not parallel to said first axis.

20. A trench drain comprising:

a longitudinally extending channel extending along a longitudinal axis having a first side wall spaced apart from a second side wall, a first end and a second end, and a bottom wall connected to said first side wall and said second side wall, said channel having an inner surface and an outer surface, said inner surface defining a flow passage, each of said first side wall and said second side wall having a first portion adjacent to said bottom wall and a second portion connected to said first portion, said first portions of said first side wall and said second side wall spaced apart a first lateral distance and said second portions of said first side wall and said second side wall spaced apart a second lateral distance and form a throat, the first lateral distance greater than the second lateral distance;

a support rod clip attached to said outer surface of one of said first side wall and said second side wall, said support rod clip adapted to engagingly receive a support rod extending along a first axis;

a reinforcing rod clip attached to said outer surface of one of said first side wall and said second side wall, said reinforcing rod clip adapted to engagingly receive a reinforcing rod extending along a second axis, wherein the first axis is not parallel to the second axis;

a protuberance extending from said outer surface of said channel adapted to interact with material into which said outer surface of said trench drain is embedded; and a removable cover secured to said throat and positioned opposite said bottom wall forming a close-faced channel, whereby removing said removable cover forms an open-faced channel.

21. A trench drain as claimed in claim 20, wherein said second portions are asymmetric with respect to a plane extending longitudinally along said channel and said first portion of said first side wall and said first portion of said second side wall are symmetric with respect to the plane.

22. A trench drain as claimed in claim 2, wherein the first axis is transverse to the longitudinal and the second axis is parallel to the longitudinal axis.

* * * * *

UNITED STATES PATENT AND TRADEMARK OFFICE

CERTIFICATE OF CORRECTION

PATENT NO. : 6,000,881

DATED : December 14, 1999

INVENTOR(S) : Allen R. Becker et al.

It is certified that error appears in the above-identified patent and that said Letters Patent is hereby corrected as shown below:

Column 9 Line 8, Claim 6, "in claim 7" should read --in claim 5--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*